United States Patent [19]

Armstrong et al.

[11] 4,335,005

[45] Jun. 15, 1982

[54] LUBRICANT COMPOSITIONS CONTAINING METAL ANTIFATIGUE ADDITIVES

[75] Inventors: Eldon L. Armstrong, Mullica Hill; Phillip S. Landis, Woodbury, both of N.J.

[73] Assignee: Mobil Oil Corporation, New York, N.Y.

[21] Appl. No.: 186,095

[22] Filed: Sep. 11, 1980

[51] Int. Cl.[3] ..... C10M 1/10; C10M 3/02; C10M 7/02; C10M 7/48

[52] U.S. Cl. ..... 252/49.6

[58] Field of Search ..... 252/49.6

[56] References Cited

U.S. PATENT DOCUMENTS

| | | | |
|---|---|---|---|
| 3,509,054 | 4/1970 | Hinkamp et al. | 252/49.6 |
| 3,755,175 | 8/1973 | Clark et al. | 252/49.6 |
| 3,816,313 | 6/1974 | Szieleit | 252/49.6 |
| 4,016,092 | 4/1977 | Andress | 252/49.6 |
| 4,119,552 | 10/1978 | Davis et al. | 252/49.6 |

FOREIGN PATENT DOCUMENTS

| | | | |
|---|---|---|---|
| 794380 | 4/1958 | United Kingdom | 252/49.6 |
| 1271556 | 4/1972 | United Kingdom | 252/49.6 |

*Primary Examiner*—Delbert E. Gantz
*Assistant Examiner*—Helane E. Maull
*Attorney, Agent, or Firm*—Charles A. Huggett; Michael G. Gilman; James D. Tierney

[57] ABSTRACT

Compositions comprising arylboronic acid and substituted arylboronic acid are employed as lubricant additives to impart anti-fatigue properties to metals. In an embodiment, approximately one weight percent of phenylboronic acid added to a polyurea thickened grease containing about two percent of water, results in vastly improved resistance to metal-fatigue failure such as spalling, for example.

5 Claims, No Drawings

LUBRICANT COMPOSITIONS CONTAINING METAL ANTIFATIGUE ADDITIVES

BACKGROUND OF THE INVENTION

1. Field of the Invention

The present invention relates to lubricant compositions, and more particularly to improved lubricant compositions, such as oils and greases, suitable for use as lubricants for metals which normally exhibit fatigue in the course of performing their functions.

2. Description of the Prior Art

The prior art has long recognized the phenomenon of "metal-fatigue", which, essentially, involves metal deterioration due to the application of cyclic stresses in undergoing use, as, for example, in rolling contact bearings. In order to induce anti-fatigue properties to the lubricating medium, and particularly where the lubricant is, to some extent, water-contaminated, various additives have heretofore been suggested as anti-fatigue agents. Such additives have not, however, been found sufficiently sucessful to justify extensive commercial use as lubricant additives.

SUMMARY OF THE INVENTION

It has now been found that highly superior anti-fatigue properties can be imparted to lubricant compositions by incorporating therein minor amounts of an arylboronic acid such as phenylboronic acid or substituted phenylboronic acid.

Insofar as the lubricant medium, per se, is concerned, this may comprise any liquid hydrocarbon oil, in the form of either a mineral oil or a synthetic oil, or in the form of a grease in which any of the aforementioned oils are employed as a vehicle. In general, mineral oils, employed as the lubricant, or grease vehicle, may be of any suitable lubricating viscosity range, as, for example, from about 45 SSU at 100° F. to about 6,000 SSU at 100° F., and, preferably, from about 50 to about 250 SSU at 210° F. These oils may have viscosity indexes varying from below zero to about 100 or higher. Viscosity indexes from about 70 to about 95 are preferred. The average molecular weights of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation.

In instances where synthetic oils, or synthetic oils employed as the vehicle for the grease, are desired in preference to mineral oils, or in combination therewith, various compounds of this type may be successfully utilized. Typical synthetic vehicles include polyisobutylene, polybutenes, hydrogenated polydecenes, didodecylbenzene, polypropylene glycol, polyethylene glycol, trimethylol propane esters, neopentyl and pentaerythritol esters, di(2-ethylhexyl) sebacate, di(2-ethyl hexyl) adipate, di-butylphthalate, fluorocarbons, silicate esters, silanes, esters of phosphorous-containing acids, liquid ureas, ferrocene derivatives, hydrogenated mineral oils, chain-type polyphenyls, siloxanes and silicones (polysiloxanes), alkyl-substituted diphenyl ethers typified by a butyl-substituted bis(p-phenoxyphenyl) ether, phenoxy phenylethers, and others.

In accordance with the present invention, it has been found that additive amounts of an arylboronic acid result in a surprisingly vast improvement in the resistance which metallic surfaces offer to metal fatigue when such additives are present in the lubricant system employed. Such boronic acid compounds have the following general formula:

$$(R)_x Ar\text{-}B(OH)_2$$

wherein R is an alkyl group, Ar is an aryl group containing from about 6 up to about 14 carbon atoms and x may be 0 to 5 inclusive. It will be understood that when x is 0 the Ar has its normal hydrogen complement. It will be further understood that Ar includes the phenyl, naphthyl and anthryl moieties It has been theorized that the essential element for activity in such additives is the C-B-OH linkage. Accordingly, alkyl substituent groups (in the case where Ar is phenyl) on the benzene ring provide an active antifatigue additive. The structure for the antifatigue additives of the present invention, when Ar is phenyl, may be represented as follows:

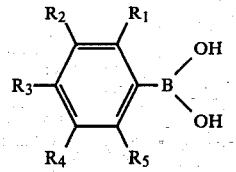

wherein $R_1$, $R_2$, $R_3$, $R_4$ and $R_5$ can be the same or different and may be H, alkyl, aryl, alkanyl, aralkyl or cycloalkyl. The size of the alkyl group may vary within wide limits, however, a total of up to about 40 carbon atoms is preferred. Thus where $R_1=R_2=R_3=C_{12}H_{25}$ and $R_4=R_5=H$ is a typical example. Also where $R_1=CH_3$ and $R_3=C_6H_{13}$, $R_5=CH_3$, $R_2=R_4=H$; or where $R_3=CH_3$; $R_1=R_2=R_4=R_5=H$ are additional typical embodiments.

A particularly preferred embodiment of the additive materials of the present invention is phenylboronic acid, a commercially available material supplied by the Allrich Chemical Company, Milwaukee, Wis. and others. It is also identified as phenylboric acid or benzene boronic acid and has the following structural formula:

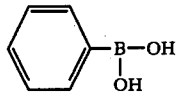

Generally, the phenylboronic acid compounds may be incorporated in the lubricant in any amount sufficient to improve metal fatigue. For most applications the additive is employed in an amount from about 0.01 to about 2%, by weight, of the total weight of the lubricant composition.

DESCRIPTION OF SPECIFIC EMBODIMENTS

In order to demonstrate the improvement in metal antifatigue realized by employment of the above-described antifatigue agents of the present invention, contrasted with identical grease compositions in the absence of such additives, comparison data were obtained as shown in the examples of the following Table.

The data were obtained utilizing an SKF spin-rig employing the rolling four-ball fatigue test. The test was a modification of the Institute Petroleum Method IP 300/75. The test conditions comprised:

| | |
|---|---|
| Test Components: | 4 Balls (1.27 cm diam.) |
| Steel Specimen: | SAE 52100, 63-65 RC |
| Speed: | 980 RPM |
| Temperature: | Self-Induced |
| Max Hertz Pressure: | 5.1 GPa |
| Grease Application: | Continuous Pumping (2.2 g/H) |

The modification to the aforenoted IP 300 Test consisted of:

| |
|---|
| Special SKF race* |
| Reduced load** |
| and |
| Reduced speed |
| Continuous pumping of test greases |

*This race replaced the standard 4 ball cup assembly and is a conforming race in which the bottom three balls are free to rotate. It is manufactured by SKF, Philadelphia, Pa. and contained a bronze cage assembly as a ball separator.
**Normal speed is 1500 RPM and normal load is 600 kg. 980 RPM and 105 kg were employed in this test. This gives a maximum Hertz of 5.1 GPa.

TABLE 1

HOURS TO FATIGUE SPALL FAILURE OF TOP BALL

| Dry Grease Polyurea Thickener in 100 cs at 40° C. Paraffinic Oil | Wet Grease w. 2% water | Wet Grease with 1% Phenylboronic acid w. 2% water |
|---|---|---|
| 41 hours | 18 hours | 49 hours |
| 47 hours | 21 hours | 63 hours |
| 75 hours | 38 hours | 96 hours |
| 111 hours | 40 hours | 98 hours |
| 134 hours | 41 hours | 294 hours |
| 195 hours | 48 hours | 300 hours |
| $L_{50}$ Life, Hrs. 136 | 39 | 130 |

The results in Table 1 show that the fatigue life span in hours for the dry grease is 41-399 hours. For the wet grease, the life span is greatly reduced to 18-58 hours by the addition of 2% water. When the wet grease is additivated with 1% phenylboronic acid, the life span is increased about 3× up to 49-300 hours, or about the same range as for dry grease. Thus, the additives of the present invention mitigate the adverse effects of the water on the fatigue life of the top ball. Using Weibull statistics, the $L_{50}$ (average life) of the test population is 136 hours for the dry grease. With 2% water, the wet grease $L_{50}$ life drops to 39 hours. With 1% phenylboronic acid added to the wet grease, the $L_{50}$ life is 130 hours, essentially equivalent to the dry grease $L_{50}$ life.

While this invention has been described with reference to preferred compositions, it will be understood, by those skilled in the art, that departure from the preferred embodiments can be effectively made and are within the scope of the specification.

What is claimed is:

1. A lubricant composition comprising a major proportion of an oil selected from the group consisting of mineral oils and synthetic oils, said synthetic oils being selected from the group consisting of polyisobutylene, polybutenes, hydrogenated polydecenes, di-dodecylbenzene, polypropylene glycol, polyethylene glycol, trimethylol propane esters, neopentyl and pentaerythritol esters, di(2-ethylhexyl) sebacate, di(2-ethyl hexyl) adipate, dibutylphthalate, fluorocarbons, silicate esters, silanes, esters of phosphorous-containing acids, liquid ureas, ferrocene derivatives, hydrogenated mineral oils, chain-type polyphenyls, siloxanes and silicones, polysiloxanes, alkyl-substituted diphenyl ethers, butyl-substituted bis(p-phenoxyphenyl)ether, phenoxy phenylethers, and greases thereof containing, in an amount sufficient to improve metal-fatigue, a compound selected from the group consisting of arylboronic acids and hydrocarbyl group substituted arylboronic acids.

2. A lubricant composition as defined in claim 1 wherein said hydrocarbyl group comprises a member selected from the group consisting of alkyl, aryl, alkaryl, aralkyl and cycloalkyl.

3. A lubricant composition as defined in claim 1 wherein said amount sufficient to improve metal-fatigue comprises from about 0.01 to about 10%, by weight, of the total weight of the lubricant composition.

4. A lubricant composition as defined in claim 1 where said compound is present in an amount of from about 0.1 to about 2%, by weight, of the total weight of the lubricant composition.

5. A lubricant composition as defined in claim 1 wherein said arylboronic acid is phenylboronic acid.

* * * * *